United States Patent [19]

Doty et al.

[11] Patent Number: 4,550,474

[45] Date of Patent: Nov. 5, 1985

[54] SAFETY BELT BUCKLE

[75] Inventors: Gerald A. Doty, Crown Point; William E. Hunter, Jr., Highland, both of Ind.

[73] Assignee: Gateway Industries, Inc., Hazel Crest, Ill.

[21] Appl. No.: 553,763

[22] Filed: Nov. 21, 1983

[51] Int. Cl.[4] ..... A44B 11/26

[52] U.S. Cl. ..... 24/633; 24/637; 24/640; 24/664

[58] Field of Search ..... 24/632, 633, 634, 635, 24/636, 637, 638, 639, 640, 641, 642, 643, 644, 664, 489

[56] References Cited

U.S. PATENT DOCUMENTS

| | | | |
|---|---|---|---|
| 3,566,455 | 3/1971 | Kuszynski | 24/633 |
| 3,895,196 | 7/1975 | Lewis | 24/641 |
| 4,375,714 | 3/1983 | Korger | 24/640 |
| 4,384,391 | 5/1983 | Lindblad et al. | 24/633 |
| 4,394,792 | 7/1983 | Schmidt | 24/637 |
| 4,451,958 | 6/1984 | Robben et al. | 24/664 |

FOREIGN PATENT DOCUMENTS

| | | | |
|---|---|---|---|
| 2010955 | 7/1979 | United Kingdom | 24/641 |

*Primary Examiner*—Victor N. Sakran

*Attorney, Agent, or Firm*—Fitch, Even, Tabin & Even

[57] ABSTRACT

A safety belt buckle employs a pivoting latch plate for retaining a tongue plate tip within the buckle interior. A locking means for securing the latch mechanism in a latched position includes a sliding member mounted on the pivoting latch plate and urged forward by spring means.

10 Claims, 8 Drawing Figures

FIG. 5
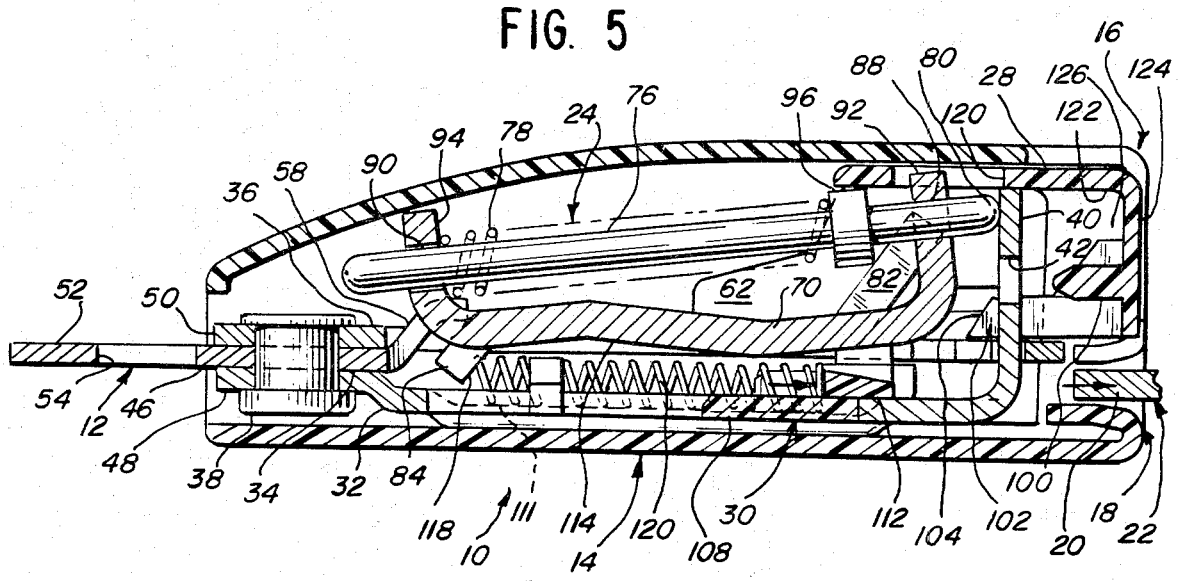
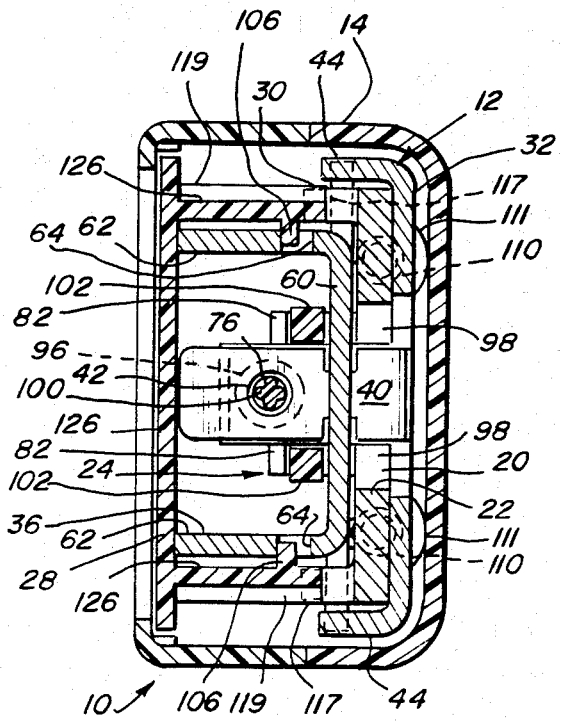
FIG. 4
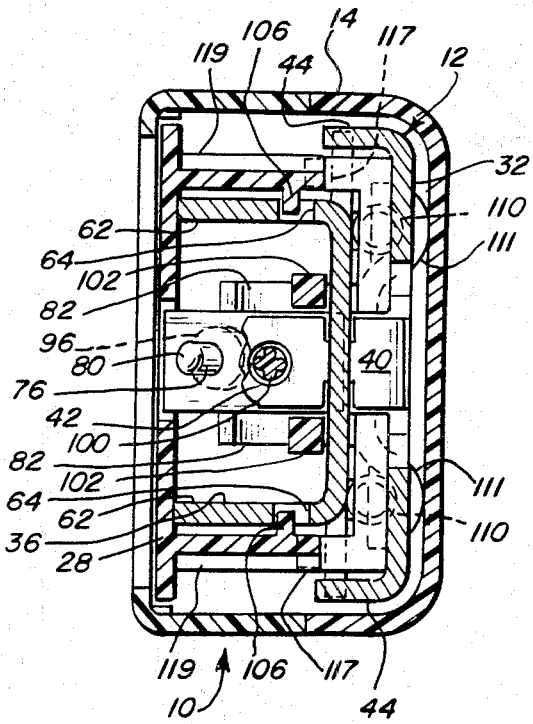
FIG. 6

SAFETY BELT BUCKLE

BACKGROUND OF THE INVENTION

The present invention relates generally to a safety belt buckle, and more particularly to a safety buckle for use in an automobile.

An automobile safety belt buckle provides a readily releasable mechanism for holding belt ends together to restrain an occupant of a motor vehicle during a collision. Various considerations affect the design and manufacture of safety belt buckles.

Because safety belt buckles are generally produced in volume, it is desirable that a buckle be capable of mass production at relatively low cost. To make safety belt buckles convenient and simple to use, it is desirable that the buckle be capable of being latched and unlatched without requiring a great deal of force or manual effort. To this end, many safety belt buckles employ an automatic latch mechanism which locks a tongue plate within the interior of the buckle upon insertion, and a push button for unlocking the buckle.

With the increased popularity of sub-compact cars in recent years, it has been found that due to the smaller size of the cars and their lighter weight, the impact forces on occupants may be increased during collision. Because of this, a seat belt buckle for a sub-compact car may be required to withstand greater tensile forces than a seat belt buckle for a larger car.

In addition to the ability to withstand relatively high tensile forces without failing, various other governmental or industry standards must be met. For example, the seat belt buckle should be releasable with a reasonable force applied to the push button even if a person is hanging upside down in the seat belt and portions of the tongue plate are forced against portions of the latch mechanism by relatively high belt tension. It is also desirable that the buckle provide a clear indication to the user when the tongue or tip is inserted fully to avoid a false latching condition.

Accordingly, it is a general object of the present invention to provide a new and improved, as constrasted with the prior art, safety belt buckle.

It is an additional object of the present invention to provide an improved safety belt buckle which may be mass produced at a commercially competitive cost.

Further objects and features of the present invention will become apparent from the following detailed description and the accompanying drawings.

BRIEF DESCRIPTION OF THE DRAWINGS

FIG. 4 is a transverse sectional view taken substantially along line 4—4 of FIG. 2.

FIG. 5 is a longitudinal sectional elevational view of the buckle of FIG. 1 with the latch mechanism shown in its upper or open position.

FIG. 6 is a transverse elevational view of the buckle of FIG. 1 with the latch mechanism shown in its upper open position.

DESCRIPTION OF THE PREFERRED EMBODIMENT

Figure 1:
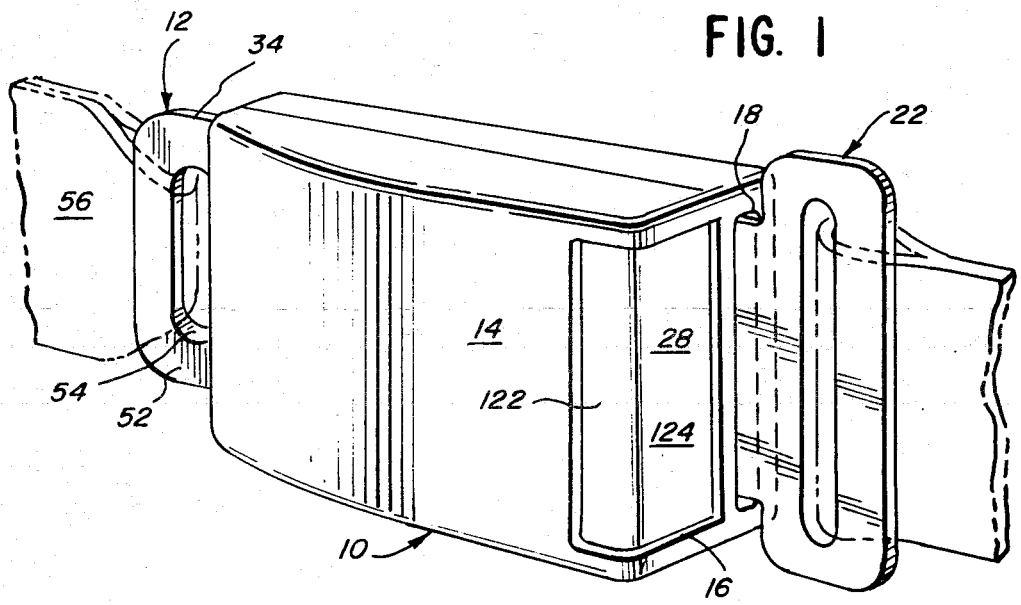
FIG. 1 is a perspective view of a safety belt buckle in accordance with the present invention.

The present invention is generally embodied in a safety belt buckle, indicated generally at 10. The buckle includes a metal frame 12 which is housed within a plastic cover 14. The plastic cover 14 and frame 12 have openings 16 and 18 respectively at their forward ends through which is inserted the tip 20 of a tongue plate 22.

Figure 2:
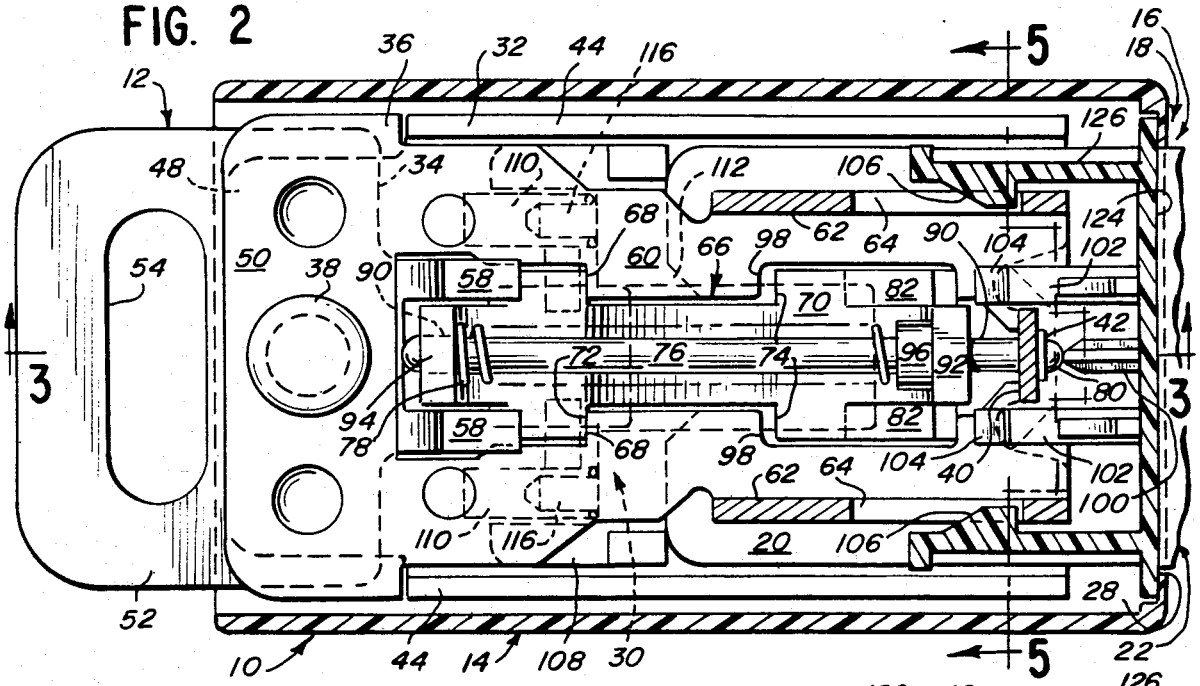
FIG. 2 is a plan view of the interior of the buckle of FIG. 1, with portions taken in section.
Figure 3:
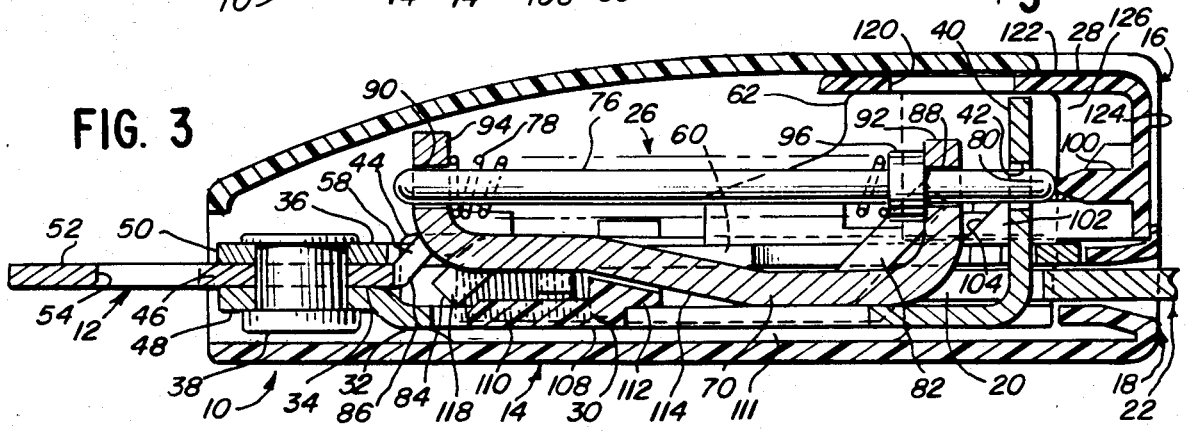
FIG. 3 is a longitudinal sectional elevational view taken substantially along line 3—3 in FIG. 2 and looking in the directions of the arrows.

For purposes of clarity herein, this description will refer to the buckle in a particular orientation wherein FIG. 2 is a plan view and FIG. 3 is an elevational view. During use, however, the buckle may assume any orientation.

A latch mechanism 24 mounted on the frame 12 is movable between a lower or closed position (FIGS. 1–4) for retaining the tip of the tongue plate within the frame and an open or upper position (FIGS. 5–6) for permitting the tongue plate tip 20 to travel in or out of the buckle frame 12. Locking means 26 are provided which are movable between a locked position (FIGS. 1–4) for maintaining the latch mechanism 24 in closed position and an unlocked position (FIGS. 5–6) for permitting the latch mechanism to move to open position.

A push button 28 enables the locking means 26 to be manually shifted to unlocked position. An ejecting actuator mechanism 30 mounted directly adjacent the latch mechanism 24 shifts the latch mechanism 24 from closed to open position and ejects the tongue plate 22 when the locking means 26 is moved from locked to unlocked position, and shifts the latch mechanism 24 from open to closed position when the tongue plate tip 20 is fully inserted into the frame 12.

The frame 12 includes a generally channel shaped base 32, an anchor plate 34 positioned upon the base 32, and a latch retainer 36 positioned upon the anchor plate 34. The base 32, anchor plate 34, and latch retainer 36 are fixed together by a rivet 38 which extends through vertical apertures formed through each of them.

To enable the locking means 26 to be held in its locked position, the frame includes means for receiving a portion of the locking means 26 in locking engagement. To this end, the base 32 herein has an upstanding arm 40 (FIG. 3) at its forward end which has an aperture 42 formed through it which cooperates with the locking means 26 in a manner described below. The base 32 further includes a pair of generally parallel, upstanding sidewalls 44 (FIG. 8) for guiding the tongue plate tip 20 as it is inserted into the frame 12.

The anchor plate 34 includes a generally flat, horizontal plate portion 46 which is sandwiched between corresponding, generally coextensive plate portions 48 and 50 on the base and latch retainer respectively. Extending rearwardly on the plate portion 46 is a portion 52 having a vertical opening 54 to interconnect with a looped belt end 56. Upwardly inclined fingers 58 extend forwardly of the flat portion 46 to engage the latch mechanism 24 in a manner described below.

The latch retainer 36 has a generally horizontal central portion 60 with a pair of upstanding sidewalls 62 at its forward end. Each of the sidewalls 62 has a longitudinally extending rectangular slot 64 formed transversely through it for guiding the push button 28. The horizontal central portion 60 has an irregularly shaped opening 66 in it which defines rearward shoulders 68 for engaging the latch mechanism 24 and preventing it from being pulled forward when subjected to tensile forces.

To retain the tongue plate tip 20 within the buckle frame 12, the latch mechanism 24 includes a pivoting latch plate 70 having a pair of rearward shoulders 72 for engaging the rearward shoulders 68 of the latch retainer and a pair of forward shoulders 74 for engaging shoulders 98 of the the tongue plate tip 20. The latch plate 70 is movable between an upper or open position (FIGS. 5–6) and a lower or latched position (FIGS. 1–4). When the latch plate 70 is in its lower position, the tongue plate tip 20 is held securely within the buckle frame 12.

In accordance with the present invention, the locking means 26 include a locking member 76 which is slidably mounted on the pivoting latch plate 70, and spring means 78 for pushing the member 76 into locked position. In the illustrated embodiment, the locking member 76 is a lock pin having a forward end 80 which extends into the aperture 42 in the upstanding arm 40 at the forward end of the base 32 when in locked position. When the lock pin 76 is in locked position, as shown in FIGS. 2–3, the latch plate 70 cannot be shifted to open position. The engagement of the forward end 80 of the lock pin 76 within the aperture 42 prevents the buckle from opening accidentally due to vibration or impact.

Figures 7, 8:
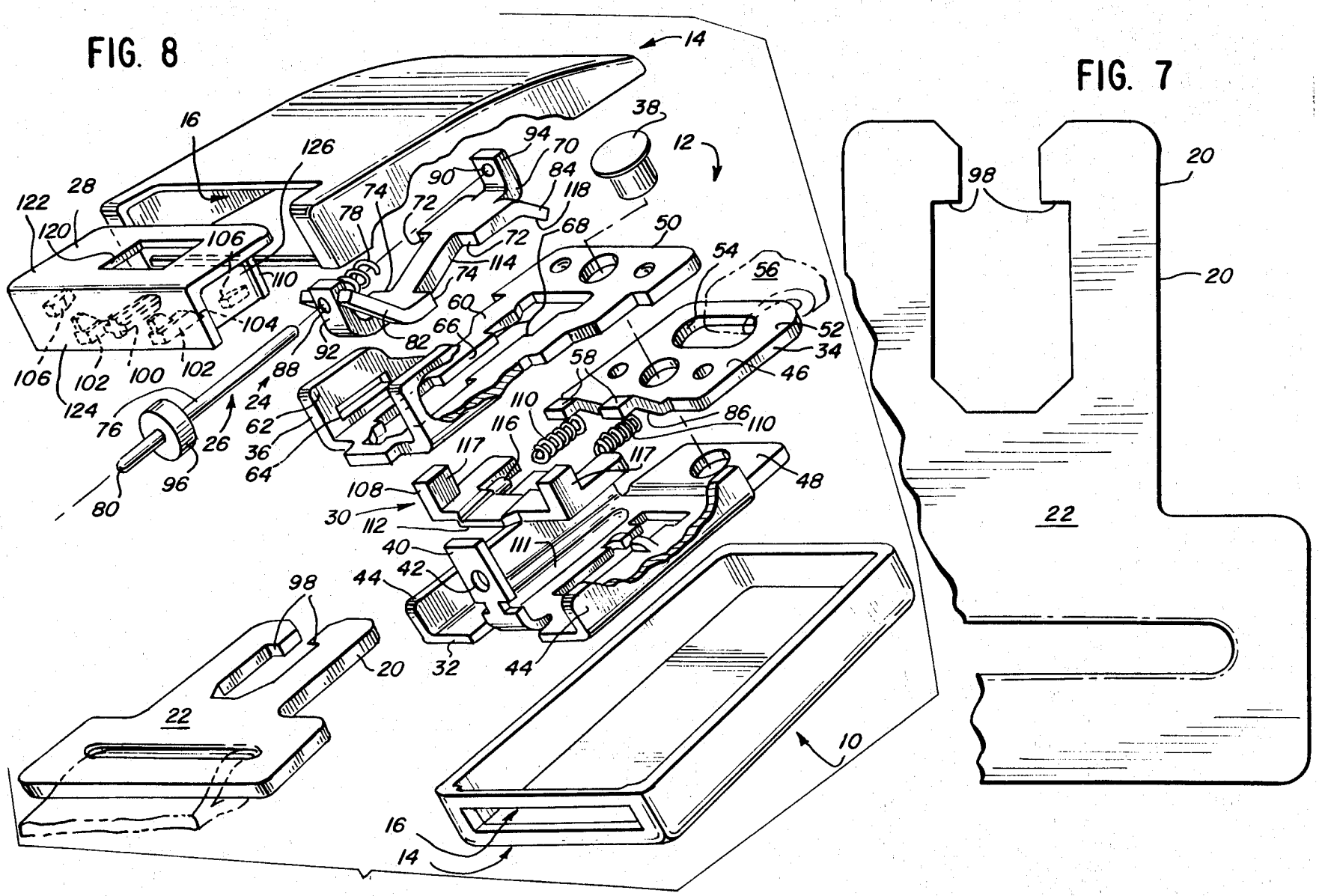
FIG. 7 is a plan view of a tongue plate adapted to cooperate with the buckle of the present invention, but shown with portions broken away.
FIG. 8 is an exploded perspective view of a buckle in accordance with the present invention, shown with portions broken away for clarity.

Turning now to a more detailed description of the illustrated embodiment of the present invention, and referring particularly to FIG. 8, to enable the latch plate 70 to be cammed to its open position by rearward movement of the push button 28, the latch plate 70 includes a pair of upwardly inclined arms 82 at its forward end which cooperate with the push button as described in greater detail below. A pair of downwardly inclined arms 84 at its rearward end engage the undersides 86 of the fingers 58 on the anchor plate 34 and pivot therearound.

The lock pin 76 is slidably supported on the latch plate 70 by guide means 88, 90. Herein, the guide means comprise aligned apertures 88, 90 formed longitudinally through upstanding front and rear lugs 92, 94 on the latch plate 70. The lock pin extends through the apertures 88, 90. To urge the pin 76 forward, the spring 78 is compressed between the rear lug 94 on the latch late 70 and an integral collar 96 on the pin. In addition to engaging the forward end of the spring 78, the collar 96 provides a stop which limits the forward travel of the pin 76. The spring preferably comprises a coil spring 78 disposed coaxially about the pin 76.

When in latched position, the forward shoulders 74 on the latch plate 70 abut a pair of shoulders 98 on the tongue plate tip 20 to retain it within the buckle 10. To maintain stability of the latch plate 70 under tensile loading, the shoulders 72, 74 on the latch plate, as well as the shoulders 98 on the tongue plate tip 20 and the shoulders 68 on the latch retainer, are oriented so that the loads to which they are subjected are substantially normal to the shoulder surfaces. This ensures that the various shoulders do not tend to slide relative to one another when high tensile forces are applied to the buckle. Accordingly, there is no tendency for the latch mechanism 24 to spring open upon application of excessive tension to the latch mechanism, nor does the buckle 10 become extremely difficult to open under excessive tension.

The push button 28 is mounted at the forward end of the buckle and is accessible through an opening 16 at the forward end of the plastic cover 14. The push button 28 includes a generally horizontal top wall 122, a transverse front wall 124 depending therefrom, and a pair of vertical sidewalls 126 abutting the top wall 122 and front wall 124.

To enable the locking means 26 to be moved from locked to unlocked position by movement of the push button rearwardly, a short push rod 100 for forcing the forward end 80 of the lock pin 76 rearwardly out of the aperture 42 in the upstanding arm 40 of the base 32 as the button 28 is pushed rearwardly extends rearwardly from the front wall 124. To shift the latch mechanism to open position by moving the button 28 rearwardly, the push button includes a pair of fingers 102 having beveled camming surfaces 104 for engaging the forward arms 82 of the latch plate 70 to pivot the latch plate 70 upwardly after the lock pin 76 has been displaced to its unlocked position. The fingers 102 herein extend rearwardly from the front wall 124 of the push button 28 and may be formed integrally therewith. The push button 28 further includes a pair of inwardly extending guide lugs 106 for engaging the rectangular slots 64 in the upstanding sidewalls 62 of the latch retainer 36. This engagement guides the push button 28 as it travels.

In some seat belt buckles in the past, no clear indication was provided as to whether the buckle was locked or unlocked. In accordance with the present invention, the actuator mechanism 30 ejects the tongue plate tip 20 from the interior of the buckle and shifts the latch plate 70 to its upper or open position automatically when the lock pin 76 is moved to its unlocked position. An additional function of the actuator mechanism 30 is to pivot the latch plate 70 to its lower or latched position upon insertion of the tongue plate tip 20 into the buckle 10. Insertion of the tip 20 part way into the buckle 10 will not create an appearance that the tip 20 is locked within the buckle 10, because the actuator mechanism 30 will eject the tip 20 if it is not inserted far enough into the buckle 10 to cause the actuator mechanism 30 to pivot the latch plate 70 into its latched position. Once the latch plate 70 is pivoted into its latched position, the locking means 26 automatically moves to its locked position to retain the tongue plate tip 20 within the buckle 10 until the push button 28 is displaced rearwardly as described above.

The actuator mechanism 30 comprises a movable ejector slide 108 and a pair of ejector springs 110 located rearwardly of the ejector slide 108 for urging it forward. To automatically shift the latch plate 70 to open position under conditions of relatively low tension without requiring application of camming force to the latch plate, the ejector slide has a tapered nose 112 which engages a sloped portion 114 of the underside of the latch plate 70 so that when the ejector slide 108 is pushed forward by the springs 110, its tapered nose 112 tends to push the latch plate upward. The springs 110 are disposed in recesses 111 in the base which constrain them against transverse movement. To prevent the springs 110 from becoming misaligned at their forward ends, the forward ends of the springs 110 receive rearwardly extending fingers 116 on the ejector slide 108.

When the lock pin 76 is in its forward or locked position, the latch plate 70 is in its lower position and the ejector slide 108 cannot travel forward because its path is obstructed by the latch plate 70 and the latch plate cannot move upward. When the lock pin 76 is moved to its rearward, or unlocked position, the ejector slide 108 automatically travels forward to eject the tongue plate tip 20 and urge the latch plate 70 upward. Under conditions of high belt tension, the spring force may be insufficient to force the latch plate 70 to its open position and may need to be supplemented by camming force provided by the engagement of the camming surfaces 104 with the upwardly sloping arms 82 on the latch plate 70.

As the ejector slide 108 travels forward, it also pushes the button 28 forward to return it to its original position. To this end, a pair of upwardly extending posts 117 on the ejector slide contact a pair of downwardly extending posts 119 at the respective rearward ends of the side walls 126 on the push button. As best seen in FIG. 5, when the latch mechanism 24 is in its open or upper position, the forward lug 92 of the latch plate extends upwardly through a generally rectangular opening 120 in the push button. This opening has a longitudinal dimension great enough to enable the push button to slide between its rearward and forward positions without interfering with the lug 92. FIG. 5 illustrates the position of the ejector slide 108, the latch mechanism 24, and the tongue plate tip 20 after the ejector slide 108 has completed its forward stroke.

As mentioned above, the latch mechanism 24 automatically shifts to closed position and the locking means 26 automatically locks it in closed position upon insertion of the tongue plate tip 20. To this end, the ejector slide 108 is adapted to push against the rearward arms 84 of the latch plate 70 and pivot the latch plate 70 downward when the ejector slide 108 is moved rearwardly by the incoming tongue plate tip 20. As best viewed in FIG. 3, the fingers 58 of the anchor plate 34 engage upper portions of the rearward arms 84 on the latch plate. The ejector slide 108 contacts the lower ends 118 of the rearward arms 84 as it travels rearwardly. A moment is thus applied to each of the rearward arms 84 of the latch plate as the ejector slide 108 travels rearwardly to pivot the latch plate 70 downwardly. The latch plate 70 pivots downwardly until the forward end 80 of the lock pin 76 reaches the aperture 42 in the upstanding arm 40 on the base 32. At this point, the lock pin spring 78 pushes the forward end 80 of the lock pin 76 through the aperture 42 to secure the latch plate 70 in its lower position.

From the foregoing, it will be appreciated that a novel safety belt buckle 10 is provided which is capable of withstanding relatively high tensile forces while providing a locking latch mechanism 24 which may be operated relatively simply and without a great deal of manual effort. Tensile loads from the seat belt are transmitted to the latch mechanism 24 through the anchor plate 34 at the rearward end of the buckle 10 and the tongue plate tip 20 at the forward end of the buckle 10. The tensile loads between load-bearing movable parts in the buckle are transmitted through the latch mechanism as compressive stresses spread over shoulder surfaces oriented substantially perpendicular to the direction of the forces. This enables the latch mechanism 24 to withstand the tensile forces without exhibiting a tendency to jam or to spring open spontaneously.

While a preferred embodiment of the present invention has been described and illustrated herein, there is no intent to limit the scope of the invention by this disclosure.

What is claimed is:

1. A safety belt buckle for retaining a tongue plate tip within its interior, the buckle comprising:

a frame means having an open forward end for receiving the tongue plate tip and an opposite rearward end for attachment to a belt end;

a latch mechanism movable between a latching position for retaining the tongue plate tip within the buckle and an open position for enabling the tongue plate tip to travel into or out of the buckle;

locking means movable between a locked position for securing the latch mechanism in its latching position and an unlocked position for enabling the latch mechanism to shift from closed position to open position; and a push button for actuating the locking means from said locked position to said unlocked position to allow release of the tongue plate tip;

the latch mechanism comprising a pivoting latch plate having guide means thereon for guiding and supporting the locking means;

the locking means comprising an elongated locking member extending in a fore and aft direction and slidably mounted on the guide means on the latch plate, said locking member having a free end for sliding forwardly and rearwardly along the latch plate while the latch plate swings to bring the free end end of the locking member into and from locking engagement with the frame means, and spring means for automatically urging the locking member toward the locked position when the latch mechanism is in its latching position.

2. A buckle in accordance with claim 1 further comprising actuator means for shifting the latch mechanism to closed position as the tongue plate tip is pushed into the buckle.

3. A buckle in accordance with claim 2 wherein the actuator means automatically shifts the latch means from closed to open position upon movement of the locking mechanism from locked to unlocked position.

4. A buckle in accordance with claim 2 wherein the actuator means automatically ejects the tongue plate tip from the buckle interior when the locking means is moved from locked position to unlocked position.

5. A safety belt buckle for retaining a tongue plate tip within its interior, the buckle comprising:

a frame means having an open forward end for receiving the tongue plate tip and an opposite rearward end for attachment to a belt end;

a latch mechanism movable between a latching position for retaining the tongue plate tip within the buckle and an open position for enabling the tongue plate tip to travel into or out of the buckle;

locking means movable between a locked position for securing the latch mechanism in its latching position and an unlocked position for enabling the latch mechanism to shift from closed position to open position; and a push button for actuating the locking means from said locked position to said unlocked position to allow release of the tongue plate tip;

the latch mechanism comprising a pivoting latch plate having guide means thereon for guiding and supporting the locking means;

the locking means comprising a locking member slidably mounted on the guide means and spring means for automatically urging the locking member toward the locked position when the latch mechanism is in its latching position, said guide means comprising a pair of lugs extending upwardly at the forward and rearward ends of the latch plate and having openings formed through them to receive portions of the locking means.

6. A safety belt buckle for retaining a tongue plate tip within its interior, the buckle comprising a metal frame having an open forward end for receiving the tongue plate tip and an opposite rearward end for securing the frame to a belt end;

a plastic cover substantially enclosing the frame;

a latch mechanism movable between a closed position for retaining the tongue plate tip within the buckle and an open position for enabling the tongue plate to travel in or out of the buckle;

actuator means for shifting the latch mechanism to closed position as the tongue plate tip is pushed into the buckle;

locking means movable between a locked position for securing the latch mechanism in its closed position and an unlocked position for enabling the latch mechanism to shift from closed position to open position;

and a push button movable between a forward position and a rearward position for moving the locking means from its locked position to its unlocked position;

the locking means comprising an elongated, generally cylindrical lock pin, a collar on the lock pin and spring means extending rearwardly from the collar for urging the lock pin forward;

the frame including a generally channel-shaped base having an upstanding arm at its forward end with an aperture formed therethrough to receive the forward end of the lock pin assembly when the buckle is in locked position, an anchor plate fixed to the base and having an opening at its rear end for receiving a looped portion of said belt end and having a pair of fingers extending forwardly and upwardly from its forward end for engaging portions of the latch mechanism, and a latch retainer positioned above the anchor plate and affixed thereto and having a pair of upstanding sidewalls at its forward end with longitudinal slots formed therethrough and a generally planar bottom having an irregularly shaped slot for engaging portions of the latch mechanism;

the latch means comprising a latch plate including a pair of upwardly inclined arms at its forward end, a pair of downwardly inclined arms at its rearward end for engaging the fingers of the anchor plate and providing a pivot for the latch means, and upwardly extending forward and rearward lugs having aligned apertures formed therethrough for receiving respective forward and rearward ends of the lock pin;

the actuator means comprising a longitudinally movable ejector slide and a pair of longitudinally extending coil springs for urging the ejector slide forward; and the push button including short push rod for displacing the forward end of the lock pin from the aperture in the upstanding arm of the base when the button is pushed rearwardly, and a pair of rearwardly extending fingers having beveled camming surfaces for engaging the upwardly inclined arms of the latch plate to shift the latch mechanism to the open position when the button is pushed.

7. A safety belt buckle in accordance with claim 6 wherein the actuator means automatically shifts the latch means from closed to open position upon movement of the locking mechanism from locked to unlocked position.

8. A buckle in accordance with claim 6 wherein the actuator means automatically eject the tongue plate tip from the buckle interior when the locking means is moved from locked position to unlocked position.

9. A buckle in accordance with claim 6 wherein the actuator means automatically returns the push button to its forward position upon movement of the locking mechanism from locked to unlocked position.

10. A buckle in accordance with claim 6 wherein said base further includes a pair of longitudinally extending recesses for constraining said longitudinally extending coil springs against transverse movement.

* * * * *

UNITED STATES PATENT AND TRADEMARK OFFICE

CERTIFICATE OF CORRECTION

PATENT NO. : 4,550,474

DATED : November 5, 1985

INVENTOR(S) : GERALD A. DOTY and WILLIAM E. HUNTER, Jr.

It is certified that error appears in the above-identified patent and that said Letters Patent is hereby corrected as shown below:

Column 1, lines 43-44, change "constrasted" to --contrasted--.

Column 3, line 11, second occurrence after "of" delete --the--.

Column 3, line 47, change "late" to --plate--.

Column 6, line 25, Claim 1, first instance, delete "end".

Column 7, line 4, after comprising insert --:--(colon).

Signed and Sealed this

*Twenty-fifth* Day of *March 1986*

[SEAL]

*Attest:*

DONALD J. QUIGG

*Attesting Officer*

*Commissioner of Patents and Trademarks*